US009669966B2

(12) United States Patent
Ruijssenaars et al.

(10) Patent No.: US 9,669,966 B2
(45) Date of Patent: Jun. 6, 2017

(54) METHOD AND APPARATUS FOR WINE BOTTLE PACKAGING AND DISPLAY

(71) Applicant: E. & J. Gallo Winery, Modesto, CA (US)

(72) Inventors: Robert Ruijssenaars, Modesto, CA (US); Jennifer Brady, Modesto, CA (US); Alex Lee, Modesto, CA (US); Royal Addis, Modesto, CA (US); Laura Hoffman, Dublin, CA (US); Doug Thompson, Tracy, CA (US); Benjamin Jones, Turlock, CA (US)

(73) Assignee: E. & J. Gallo Winery, Modesto, CA (US)

( * ) Notice: Subject to any disclaimer, the term of this patent is extended or adjusted under 35 U.S.C. 154(b) by 0 days.

(21) Appl. No.: 13/672,673

(22) Filed: Nov. 8, 2012

(65) Prior Publication Data

US 2014/0124511 A1 May 8, 2014

(51) Int. Cl.
*B65D 25/06* (2006.01)
*B65B 21/02* (2006.01)
(Continued)

(52) U.S. Cl.
CPC ..... *B65D 25/06* (2013.01); *B65B 21/02* (2013.01); *B65D 5/4804* (2013.01); *B65D 5/5246* (2013.01)

(58) Field of Classification Search
CPC ..... B65D 5/4804; B65D 5/48048; B65D 5/4212–5/4262; B65D 5/5246; B65B 21/02
(Continued)

(56) References Cited

U.S. PATENT DOCUMENTS 235,575 A * 12/1880 Schroder ..... B65D 85/327 217/32
1,202,985 A * 10/1916 Fogg ..... B65D 5/4804 217/31
(Continued)

FOREIGN PATENT DOCUMENTS

EP 0901968 A1 3/1999

OTHER PUBLICATIONS

International Search Report issued Apr. 4, 2014 in corresponding PCT Application No. PCT/US2013/068640 filed Nov. 6, 2013, inventor Robert Ruijssenaars, et al.

*Primary Examiner* — Anthony Stashick
*Assistant Examiner* — James Way
(74) *Attorney, Agent, or Firm* — Steptoe & Johnson LLP

(57) ABSTRACT

The present invention provides a method and apparatus for a wine bottle packaging divider and display. The method and apparatus comprise of a divider with opposing side edges and opposing top and bottom edges. The divider has a partitioning line dividing the divider into a first section and a second section, wherein at least one of the first section and the second section is capable of displaying an advertisement. The divider also has at least one pair of elongated openings, wherein each of the at least one pair of elongated openings has an end in proximity to one of the opposing top and bottom edges, wherein said at least one pair of elongated openings is capable of being opened to the one edge and slidably coupled onto a vertical wall for displaying the advertisement. The divider is folded along the partitioning line to fit within a container for packaging the glass bottles.

17 Claims, 6 Drawing Sheets

(51) Int. Cl.
*B65D 5/496* (2006.01)
*B65D 5/52* (2006.01)

(58) Field of Classification Search
USPC ..... 220/529, 495.03, 9.4, 23.9, 551, 531, 220/530; 229/120.24, 120.38, 102.5; 206/767–768, 756–765, 45.28–45.3
See application file for complete search history.

(56) References Cited

U.S. PATENT DOCUMENTS 1,481,333 A * 1/1924 Agar ..... 206/767
1,697,231 A * 1/1929 Einson ..... 206/763
2,673,656 A * 3/1954 Cunningham ..... 217/32
2,837,216 A 6/1958 Paige
2,840,293 A 6/1958 Paige
3,059,828 A * 10/1962 Gioia ..... 206/173
3,133,632 A * 5/1964 Goldstein ..... 206/763
3,167,179 A * 1/1965 Goldstein ..... 206/763
3,216,560 A * 11/1965 Goldstein ..... 206/763
4,330,078 A 5/1982 Graser
4,544,092 A * 10/1985 Palmer ..... B65D 5/48038 217/31
4,591,090 A 5/1986 Collins et al.
4,795,083 A * 1/1989 Johnske ..... B65D 5/48038 217/32
4,813,536 A * 3/1989 Willis ..... 206/765
5,518,171 A * 5/1996 Moss ..... B65D 5/48038 229/120.36
6,293,405 B1 * 9/2001 Burch, Jr. ..... 206/767
6,293,459 B1 * 9/2001 Burch, Jr. ..... B65D 5/48038 229/120.23
6,684,591 B2 * 2/2004 Jean ..... 52/589.1
6,896,175 B2 * 5/2005 Duke ..... B65D 5/48038 229/120.36
7,546,703 B2 * 6/2009 Johnske et al. ..... 40/539
7,597,208 B2 * 10/2009 Wang ..... 220/6
7,775,419 B2 * 8/2010 Bale ..... 229/120.36
2008/0116085 A1 * 5/2008 Artis et al. ..... 206/139
2009/0321507 A1 * 12/2009 Spivey, Sr. ..... 229/244

* cited by examiner

METHOD AND APPARATUS FOR WINE BOTTLE PACKAGING AND DISPLAY

BACKGROUND

Wine is most frequently sold in glass bottles. With glass being fairly brittle material, transporting bottles in mass quantities is a delicate process. Oftentimes, glass bottles are shipped in the same container, and if the proper precautions are not taken, careless transport subjects the bottles to the dangers of being cracked open, thus wasting the product. At the end of shipment, there a need for marketing the shipped wine to the consumer. A common way of advertising wine is to place a display akin to a miniature billboard near the wine products. These displays would then generally present the supplier's and merchant's desired advertisement.

Therefore, there is a need to a method and apparatus that safely transports glass bottles placed in close proximity and is capable of being a point-of-sale advertisement at the merchant-consumer exchange.

SUMMARY

A method and apparatus for wine bottle packaging divider and display is disclosed. In accordance with an exemplary embodiment, a divider with opposing side edges and opposing top and bottom edges is provided. The divider has a partitioning line dividing the divider into a first section and a second section, wherein at least one of the first section and the second section is capable of displaying an advertisement. The divider also has at least one pair of elongated openings, wherein each of the at least one pair of elongated openings has an end in proximity to one of the opposing top and bottom edges, wherein said at least one pair of elongated openings is capable of being opened to the one edge and slidably coupled onto a vertical wall for displaying the advertisement. The divider is folded along the partitioning line to fit within a container for packaging the glass bottles.

The above and other preferred features, including various novel details of implementation and combination of elements, will now be more particularly described with reference to the accompanying drawings and pointed out in the claims. It will be understood that the particular methods and apparatuses are shown by way of illustration only and not as limitations. As will be understood by those skilled in the art, the principles and features explained herein may be employed in various and numerous embodiments.

BRIEF DESCRIPTION OF THE DRAWINGS

The accompanying drawings, which are included as part of the present specification, illustrate the presently preferred embodiment of the present invention and together with the general description given above and the detailed description of the preferred embodiment given below serve to explain and teach the principles of the present invention.

Figure 1:
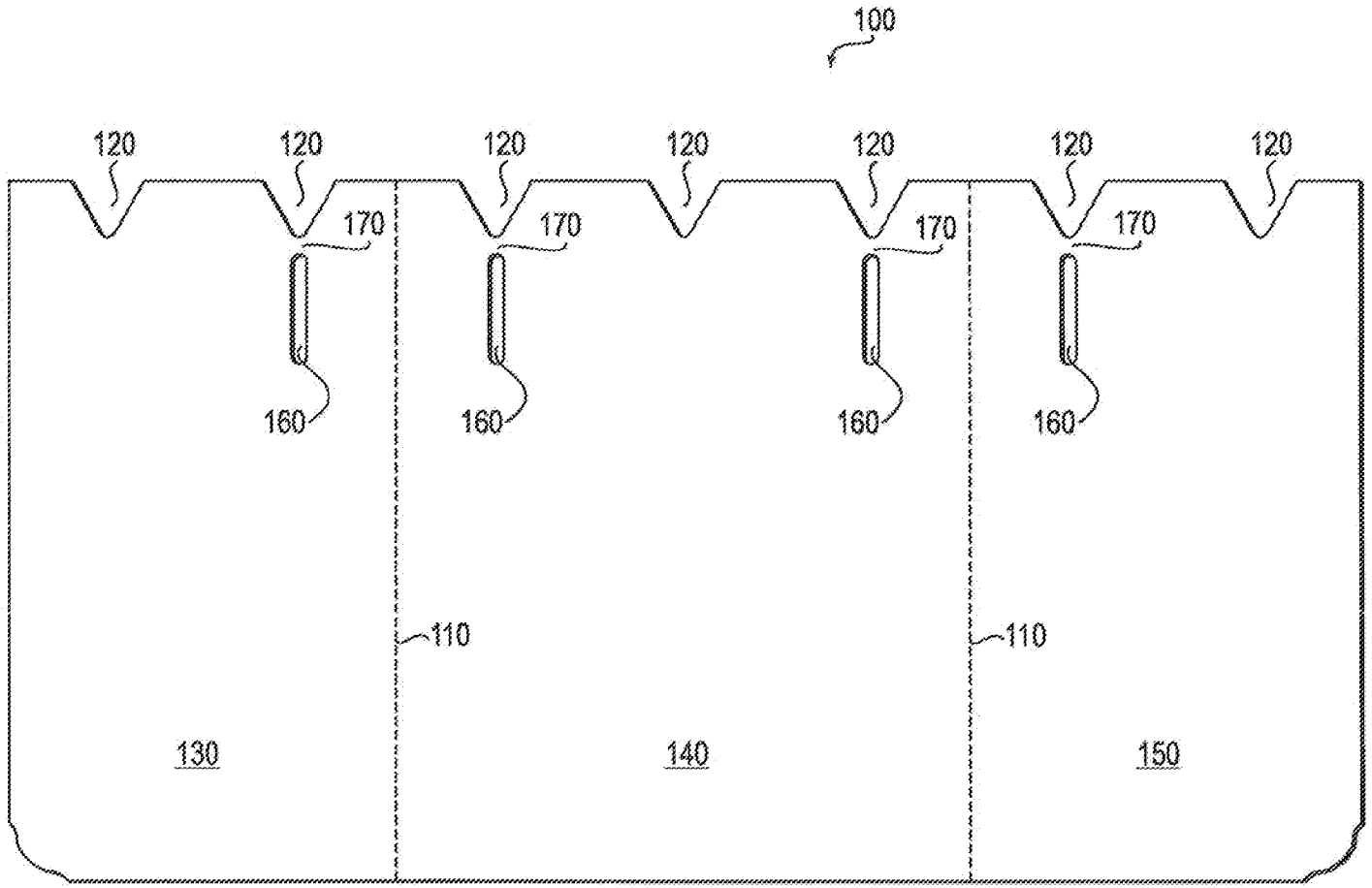
FIG. 1 is a schematic drawing of a preferred embodiment of the wine bottle packaging divider and display device, according to one embodiment.

It should be noted that the figures are not necessarily drawn to scale and that elements of structures or functions are generally represented by reference numerals for illustrative purposes throughout the figures. It also should be noted that the figures are only intended to facilitate the description of the various embodiments described herein. The figures do not describe every aspect of the teachings described herein and do not limit the scope of the claims.

DETAILED DESCRIPTION

In the following description, for purposes of clarity and conciseness of the description, not all of the numerous components shown in the schematic are described. The numerous components are shown in the drawings to provide a person of ordinary skill in the art a thorough enabling disclosure of the present invention. The operation of many of the components would be understood to one skilled in the art.

Each of the additional features and teachings disclosed herein can be utilized separately or in conjunction with other features and teachings to provide a wine bottle packaging divider and display device. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense and are instead taught merely to describe particularly representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claim are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced but are not intended to limit the dimensions and the shapes shown in the examples.

Referring to FIGS. 1-4 the subject matter is directed to a method and apparatus for wine bottle packaging divider and display. The method and apparatus serves as both a packaging separator and a protector during transport and is able to be converted to an advertisement vehicle upon arrival at a retail outlet or merchant store.

FIG. 1 is a schematic drawing of a preferred embodiment of the wine bottle packaging divider and display device, according to one embodiment. Wine bottle packaging divider and display device 100 (hereinafter referred to as "divider") is generally of a rectangular shape, and can be comprised of packaging material well known in the industry. Divide 100 contains partitioning lines 110, partitions 130, 140, and 150, elongated openings 160, and removable sections 170. In one embodiment, the divider 100 contains a plurality of triangular cuts 120 along at least one of the edges of divider 100.

In this embodiment, divider 100 is partitioned into three sections, where the two partitioning lines 110 are perforated and creased to allow partitions 130 and 150 to be folded or positioned at an angle to partition 140. Divider 100 may be sized so as to be fitted into a wine transport container suitable for transporting wine bottles, as will be further explained in FIG. 2 below.

Figure 3A:
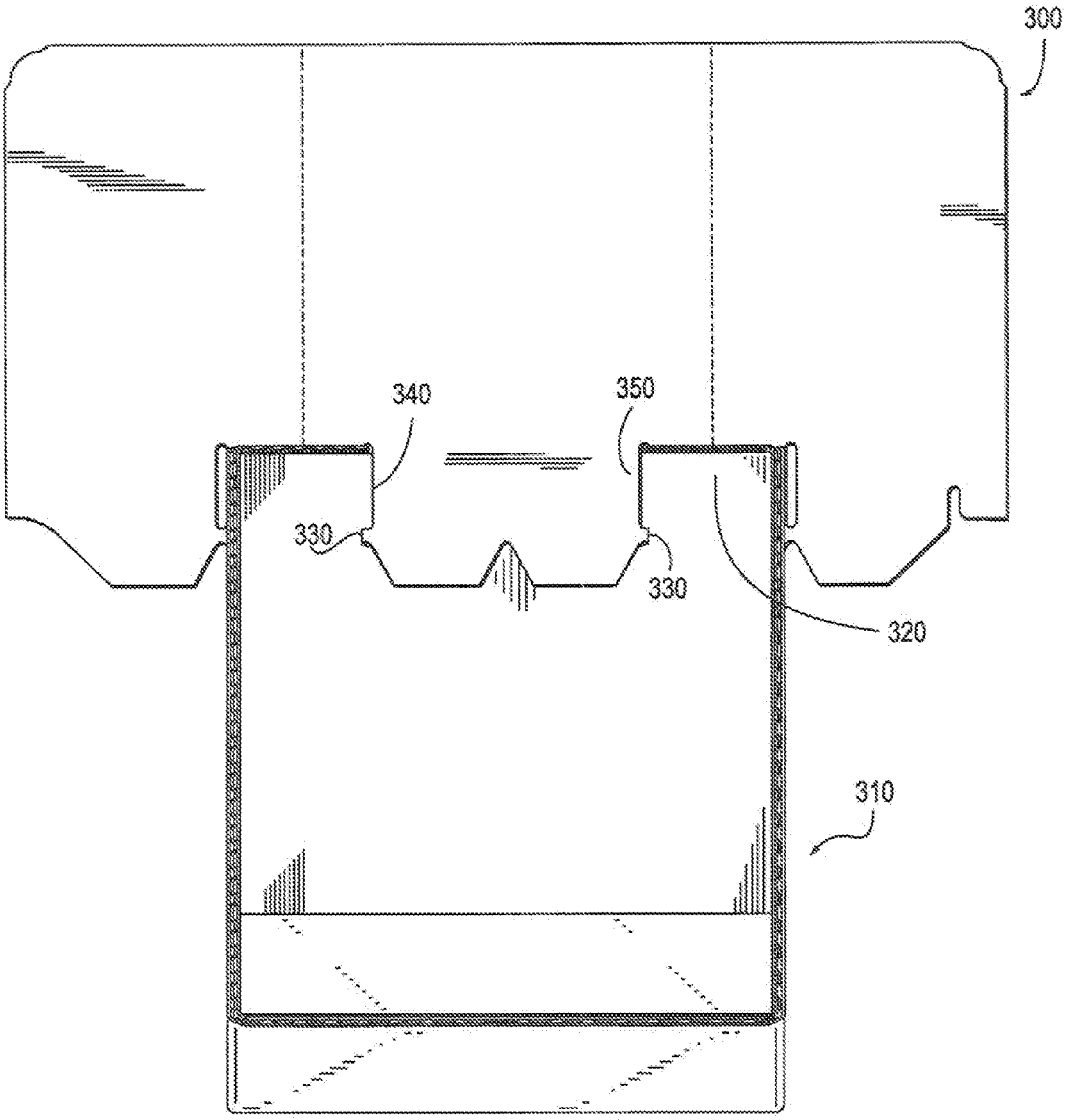
FIG. 3A illustrates an exemplary use of the wine bottle packaging divider as a display vehicle, according to one embodiment.

Additionally, divider 100 is configured to have at least one pair of elongated openings 160. In a preferred embodiment, elongated openings 160 are cut in parallel to partitioning lines 110, and are placed close to triangular out 170 so as to enable easy cutting or tearing of removable sections 170. The elongated openings 160 are spaced apart such that divider 100 can be slidably coupled to the top of one of the walls of the wine transport container in a stable with partitions 130, 140, and 150 in an alternating configuration. Alternatively, divider 100 may be slidably coupled to any suitable vertical wall when removable sections 170 are cut or torn away. An advertisement can then be printed across any of the partitions 130, 140, and 150. The merchant or retailer then places the advertisement printed across any of the partitions 130, 140, and 150 as shown in FIG. 3A. Various modifications and departures from the above description will occur to those having ordinary skill in the art which would allow the divider 100 to have a different configuration of elements than described above.

Figure 2:
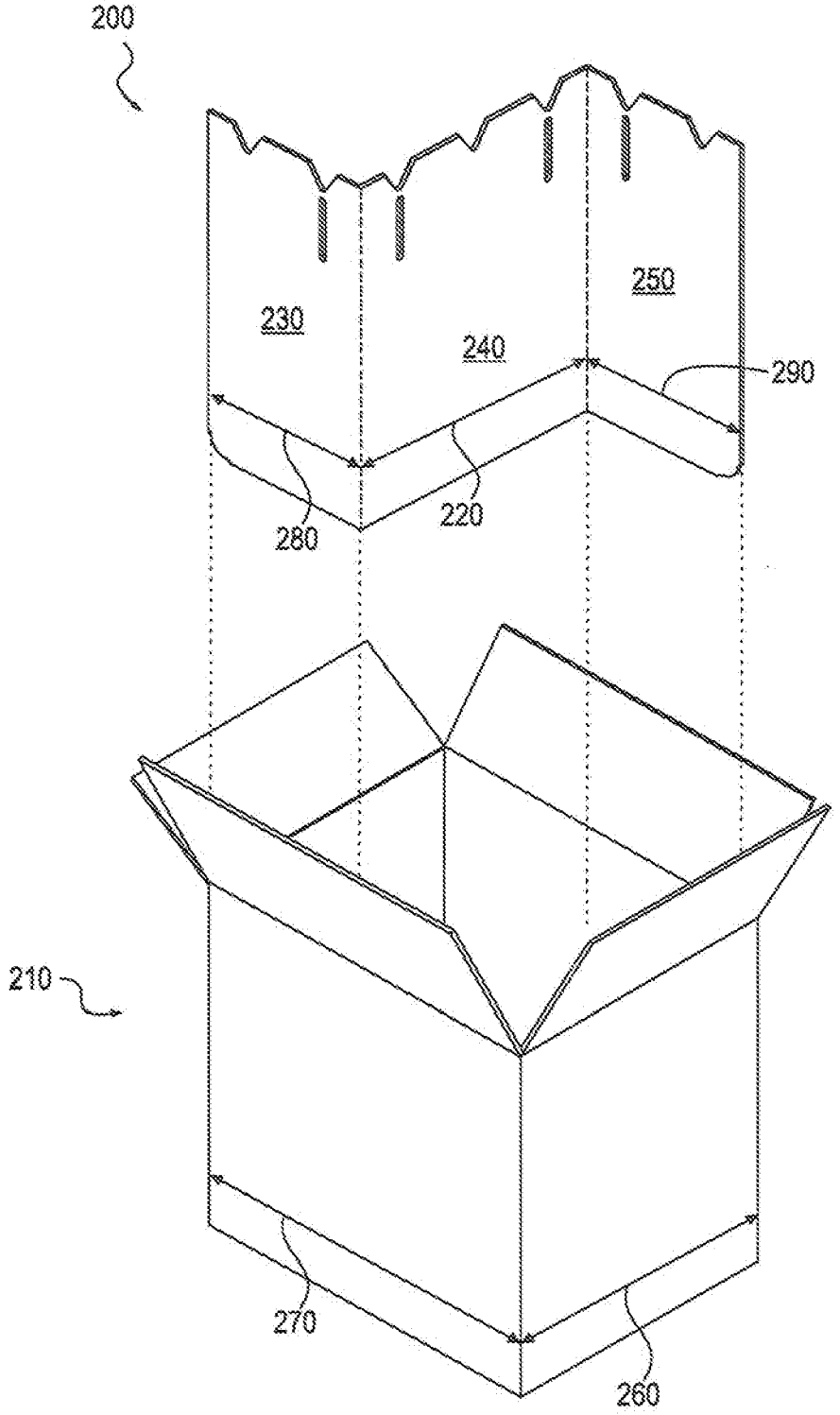
FIG. 2 is a perspective view showing how an exemplary wine bottle packaging divider and display device can be fitted into a wine transport container, according to one embodiment.

FIG. 2 is a perspective view showing how an exemplary wine bottle packaging divider and display device can be fitted into a wine transport container, according to one embodiment. Referring to FIG. 2, divider 200 may be sized so as to be fitted into a wine transport container 210 suitable for transporting multiple wine bottles. In one embodiment, the length 220 of partition 240 is sized to match the width 260 of wine transport box 210, and the combined lengths 280 and 290 of partitions 230 and 250 is less than or equal to the length 270 of wine transport box 210. Various modifications and departures from the disclosed packaging configuration will occur to those having ordinary skill in the art which would allow divider 200 to have different dimensions than those described above.

Figure 3B:
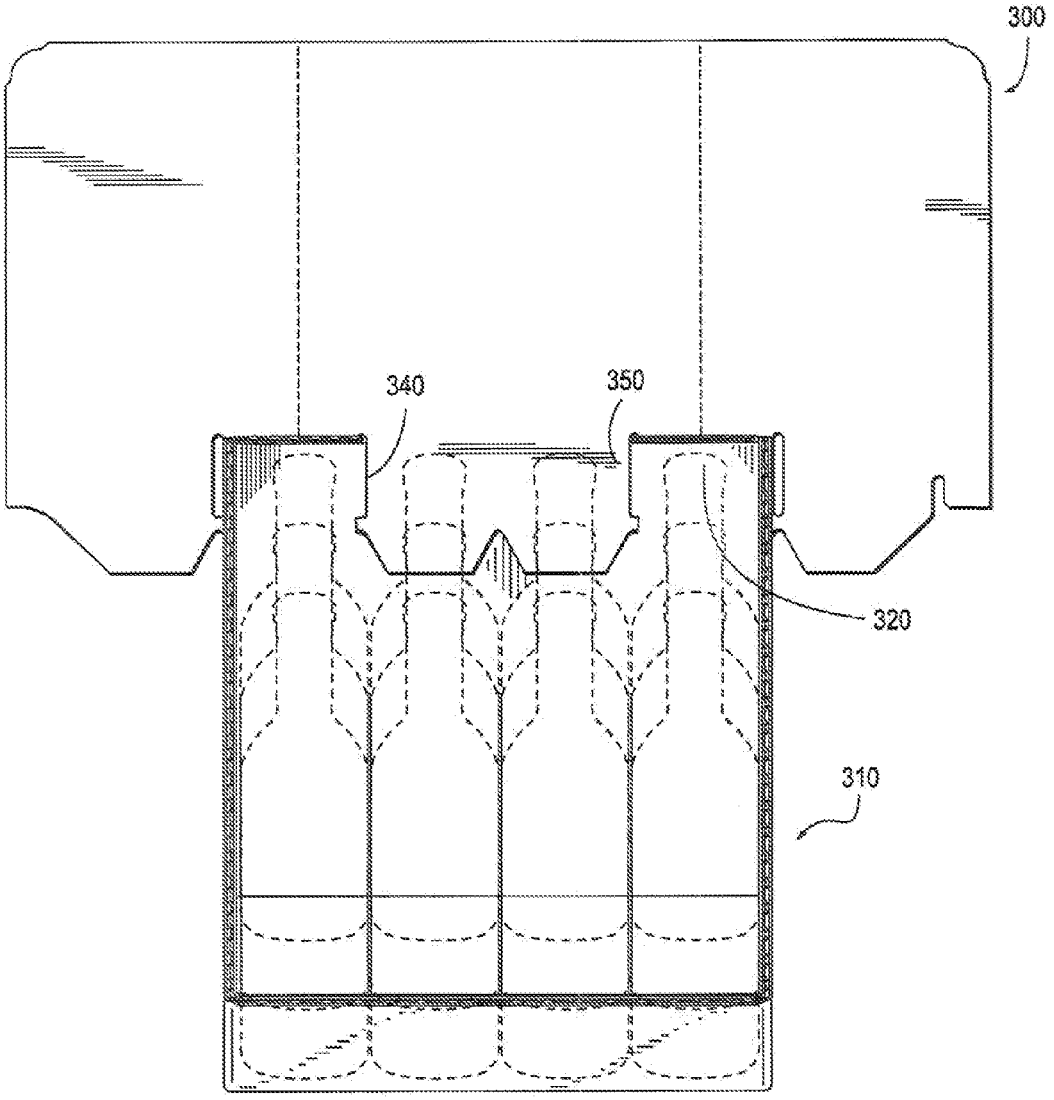
FIG. 3B illustrates another exemplary use of the wine bottle packaging divider as a display vehicle, according to one embodiment.

FIG. 3A illustrates an exemplary use of the wine bottle packaging divider as a display vehicle, according to one embodiment. FIG. 3A shows divider 300 slidably coupled to one of the walls 320 of the wine transport container 310. In this embodiment, sections 330 are removed to free the elongated openings 340 and 360. Divider 300 is then slidably coupled onto one of the walls 320 to form a visible advertisement above the wine transport container 310. FIG. 3B illustrates the same embodiment as FIG. 3A, but includes example wine bottles drawn for perspective.

Figure 4A:
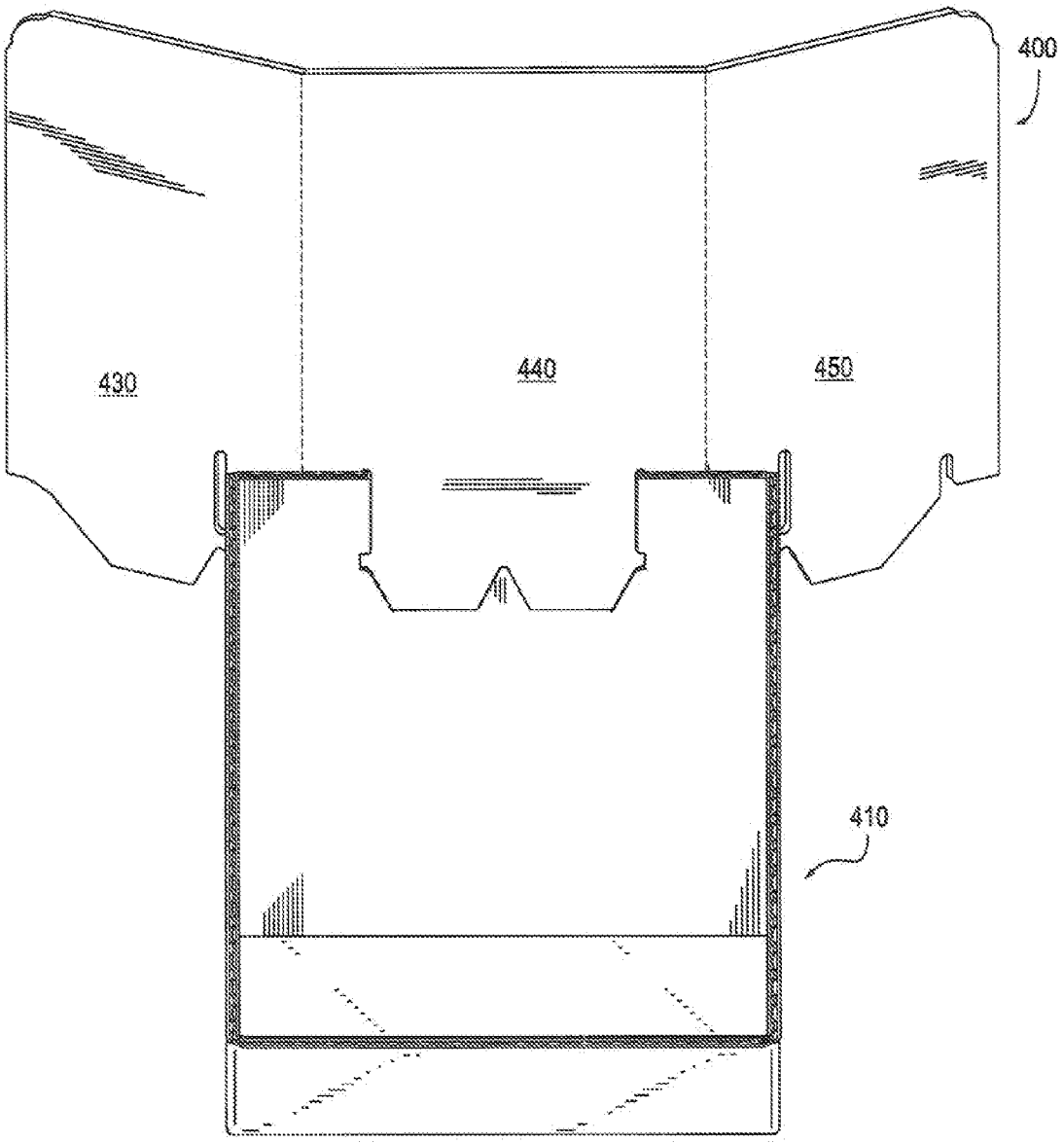
FIG. 4A illustrates another use of a wine bottle packaging divider as a display vehicle with the outer partitions of the packaging device folded at an angle, according to one embodiment.
Figure 4B:
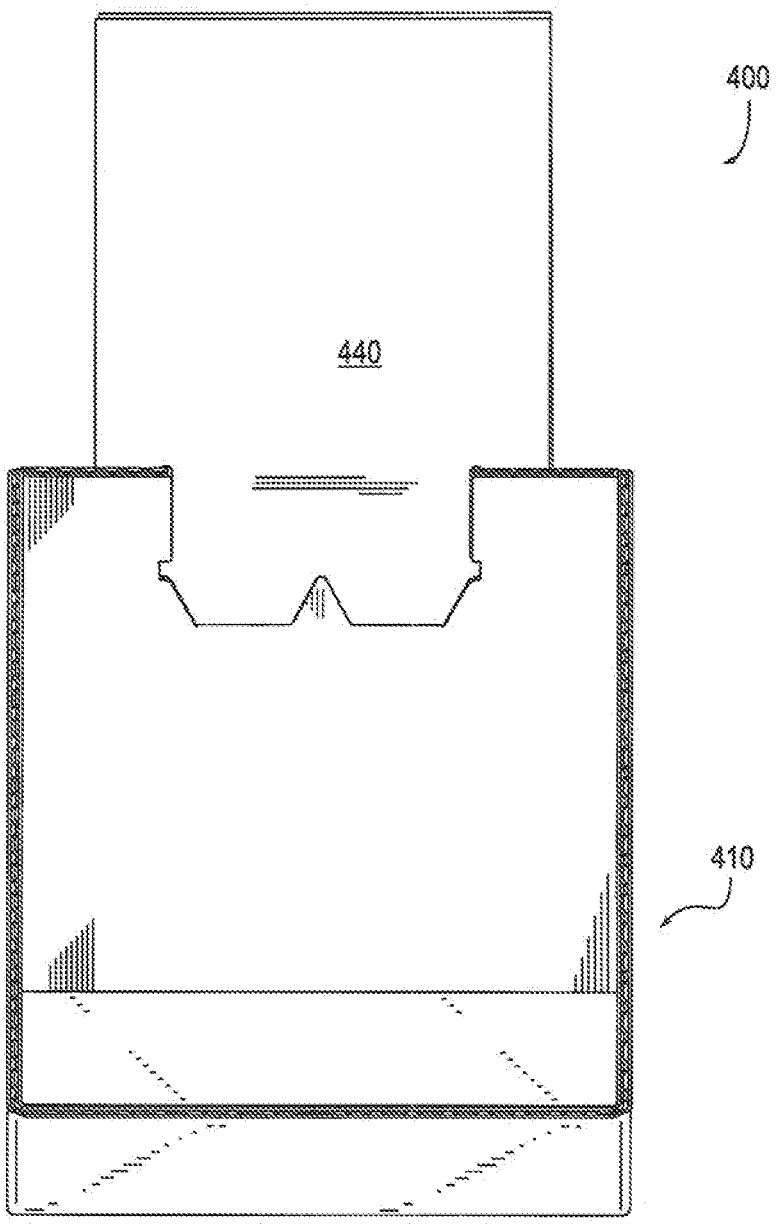
FIG. 4B illustrates another use of a wine bottle packaging divider as a display vehicle with the outer partitions of the packaging device removed, according to one embodiment.

FIG. 4A illustrates another use of a wine bottle packaging divider as a display vehicle with the outer partitions of the packaging device folded at an angle, according to one embodiment. Divider 400 is attached to wine transport container 410, similar to the embodiment as described in FIG. 3. In this embodiment, divider 400 has had outer partitions 430 and 450 folded at an angle to partition 440. FIG. 4B illustrates another use of a wine bottle packaging divider as a display vehicle with the outer partitions of the packaging device removed, according to one embodiment. FIG. 4B shows divider 400 where outer partitions 430 and 850 have been removed, thus leaving partition 440 as the display vehicle.

Embodiments as described herein have significant advantages over previously developed implementations. As will be apparent to one of ordinary skill in the art, other similar apparatus arrangements are possible within the general scope. The embodiments described above are intended to be exemplary rather than limiting, and the bounds should be determined from the claims.

We claim:

1. A divider for packaging glass bottles comprising:
- opposing side edges;
- a top edge;
- a bottom edge;
- a partitioning line dividing the divider into a first section and a second section, wherein at least one of the first section and the second section is capable of displaying an advertisement;
- an elongated opening having an end in proximity to the top edge and a complete circumference, the elongated opening is completely enclosed by the material of the divider;
- a triangular cut formed along the top edge, the triangular cut is above the elongated opening; and
- a physical barrier of the divider that separates the triangular cut from the elongated opening, the physical barrier comprises a solid tearable material, and the physical barrier tears in order to provide an access to the elongated opening from the top edge via the corresponding triangular cut, such that the divider slides onto a vertical wall for displaying the advertisement.

2. The divider of claim 1, wherein the vertical wall is a wall of the container.

3. The divider of claim 1, wherein the partitioning line is perforated.

4. The divider of claim 3, wherein the first section is detached from the second section.

5. The divider of claim 3, wherein the elongated opening is configured in parallel with the partitioning line.

6. The divider of claim 5, wherein the container contains six glass bottles.

7. The divider of claim 5, wherein the container contains twelve glass bottles.

8. A system for packaging glass bottles comprising:
- a container having a vertical wall; and
- a divider comprising:
  - opposing side edges;
  - a top edge;
  - a bottom edge;
  - a partitioning line dividing the divider into a first section and a second section, wherein at least one of the first section and the second section is capable of displaying an advertisement;
  - an elongated opening having an end in proximity to the top edge;
  - a triangular cut formed along the top edge and above the elongated opening; and
  - a physical barrier of the divider that separates the triangular cut from the elongated opening, wherein the physical barrier comprises a solid tearable material that tears to open the elongated opening to the top edge.

9. The system of claim 8, wherein the container contains six glass bottles.

10. The system of claim 8, wherein the container contains twelve glass bottles.

11. A method for packaging glass bottles comprising the steps of:

providing a divider, wherein the divider comprises:

opposing side edges;

a top edge;

a bottom edge;

a partitioning line dividing the divider into a first section and a second section, wherein at least one of the first section and the second section is capable of displaying an advertisement;

an elongated opening having an end in proximity to the top edge;

a triangular cut formed along the top edge and above the elongated opening; and tearing a physical barrier of the divider from the triangular cut to the elongated opening;

sliding the divider onto a vertical wall, such that the vertical wall slides through the torn physical barrier and into the elongated opening.

12. The method of claim 11, wherein the vertical wall is a wall of a container for packaging glass.

13. The method of claim 11, wherein the partitioning line is perforated.

14. The method of claim 13, further comprising detaching the first section from the second section.

15. The method of claim 13, wherein the elongated opening is configured in parallel with the partitioning line.

16. The method of claim 12, wherein the container contains six glass bottles.

17. The method of claim 12, wherein the container contains twelve glass bottles.

* * * * *